US005993286A

United States Patent [19]

Tacquard et al.

[11] Patent Number: 5,993,286

[45] Date of Patent: Nov. 30, 1999

[54] WALKING INSECT AND METHOD OF ASSEMBLING THE SAME

[76] Inventors: Timothy L. Tacquard; Patricia B. Tacquard, both of 24311 Las Naranjas, Laguna Niguel, Calif. 92677

[21] Appl. No.: 09/300,170

[22] Filed: Apr. 27, 1999

[51] Int. Cl.[6] ..... A63H 13/00

[52] U.S. Cl. ..... 446/351; 446/353; 446/35

[58] Field of Search ..... 446/3, 35, 338, 446/340, 351, 352, 353, 373, 375, 376, 383, 384

[56] References Cited

U.S. PATENT DOCUMENTS

| | | | |
|---|---|---|---|
| Re. 35,375 | 11/1996 | Park | 446/353 |
| 1,793,121 | 2/1931 | Muller | 446/351 X |
| 3,017,718 | 1/1962 | Estes | 446/338 |
| 3,626,555 | 12/1971 | Albertini et al. | 446/35 |
| 3,911,614 | 10/1975 | Terzian | 446/351 |
| 4,610,639 | 9/1986 | Piazza | 446/376 |
| 4,867,730 | 9/1989 | Lee | 446/352 X |
| 5,163,861 | 11/1992 | Van Ruymbeke | 446/35 |

*Primary Examiner*—Sam Rimell

*Attorney, Agent, or Firm*—Stetina Brunda Garred & Brucker

[57] ABSTRACT

A walking insect that comprises a torso having a set of legs and wings attached thereto. Disposed within the torso is a battery and a rotating electric motor operative to vibrate the torso. The electric motor is attached to a counterbalance and tail cone such that when the counterbalance and tail cone are rotated, the insect vibrates thereby causing the legs to move and the insect to walk. The counterbalance is adjustable in order to amplify the vibration of the insect. The insect may be sold in kit form for assembly by children as an educational toy.

19 Claims, 4 Drawing Sheets

WALKING INSECT AND METHOD OF ASSEMBLING THE SAME

CROSS-REFERENCE TO RELATED APPLICATIONS (Not Applicable)

STATEMENT RE: FEDERALLY SPONSORED RESEARCH/DEVELOPMENT (Not Applicable)

BACKGROUND OF THE INVENTION

The present invention generally relates to educational toys and more particularly to a toy that teaches children about the physical and biological sciences.

There are many different types of educational toys on the market. The goal of such toys is to provide children with educational material while still being fun to play with at the same time. The toys provide useful information to the child in a form that makes learning enjoyable.

The present invention provides an educational toy which can teach both mechanical principals and biological principals. More particularly, the present invention provides a walking insect kit which, when assembled, teaches children about the biological sciences, as well as the mechanical sciences.

BRIEF SUMMARY OF THE INVENTION

In accordance with a preferred embodiment of the present invention, there is provided a walking insect and walking insect kit that teaches children about mechanical principals as well a biological principals. As such, the walking insect comprises a torso having at least one set of flexible legs attached thereto. Mounted within the torso is a motor and an associated power source. The insect further comprises a counterbalance attached to the motor and rotatable thereby. The rotation of the counterbalance vibrates the torso and legs thereby causing the insect to walk.

In order to vary the vibration of the insect, the counterbalance may comprise an eccentric member attached to the motor and a tail cone attached to the eccentric member. The eccentric member has a circular cam portion which defines a central axis and the tail cone has a secondary axis. The tail cone is pivotally attached to the eccentric member such that the secondary axis is angularly offset relative to the central axis for purposes of adjusting the vibration of the torso. Furthermore, the insect may include a weight insertable into the tail cone for adjusting the vibration of the torso.

The insect may further comprise a set of wings that add realism by flapping when the insect is vibrated. The motor of the insect may be an electric motor that is powered by a battery. Furthermore, the insect may include a switch connected between the motor and the power source for selectively activating and deactivating the motor. The walking insect may be assembled or configured as a kit in order to teach children basic mechanical principals.

In accordance with the present invention, there is also provided a method of assembling the walking insect described above. The method comprises the steps of attaching the legs and the motor to the torso. Next, the counterbalance is attached to the motor as well as the power source. The power source is attached to the torso and rotates the motor such that the rotation of the motor vibrates the torso and legs thereby causing the insect to walk. The method can further include inserting a weight into the counterbalance to adjust the vibration of torso.

BRIEF DESCRIPTION OF THE DRAWINGS

These, as well as other features of the present invention, will become more apparent upon reference to the drawings wherein.

DETAILED DESCRIPTION OF THE INVENTION

Figure 1:
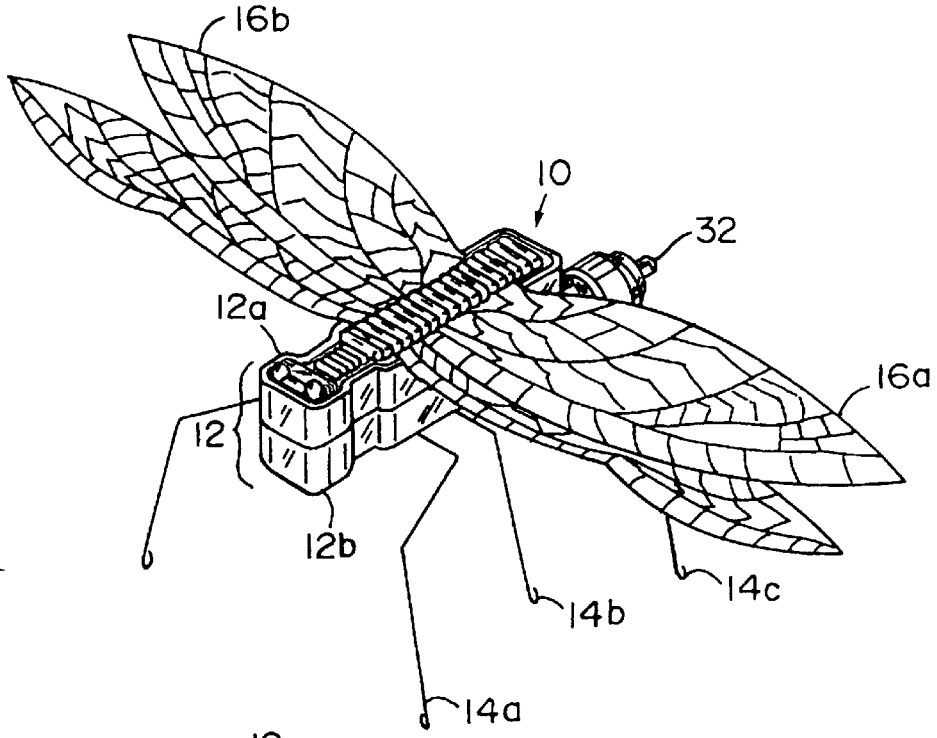
FIG. 1 is a perspective view of an assembled walking insect constructed in accordance with a preferred embodiment of the present invention.

Referring now to the drawings wherein the showings are for purposes of illustrating a preferred embodiment of the present invention only, and not for purposes of limiting the same, FIG. 1 perspectively illustrates a walking insect 10 constructed in accordance with the preferred embodiment of the present invention. The insect 10 is a children's educational toy made to look like a dragonfly. The insect 10 comprises a plastic torso 12 with three sets of legs 14*a*, 14*b*, and 14*c* attached thereto that support the torso 12 and allow the insect 10 to walk.

Figure 2:
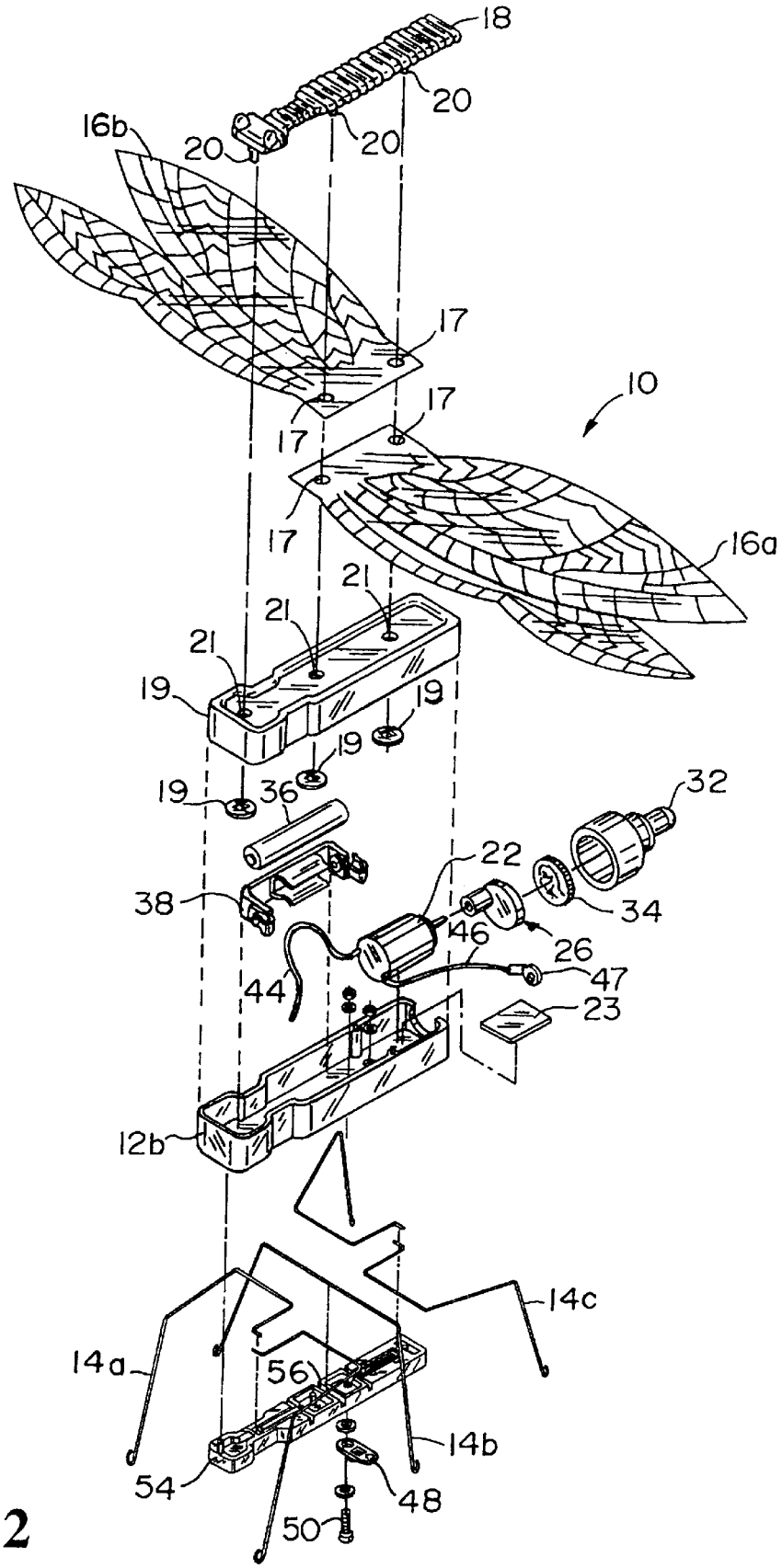
FIG. 2 is an exploded perspective view of the walking insect shown in FIG. 1.

As best seen in FIG. 2, the torso 12 of insect 10 comprises a top torso section 12*a* and a bottom torso section 12*b* which mate together. The torso sections 12*a* and 12*b*, when mated together, form an interior cavity which houses the drive mechanism for the insect 10. The torso sections 12*a* and 12*b* are secured together through the use of a snap fitting such that the torso sections 12*a* and 12*b* can be frictionally engaged to one another.

Attachable to the top torso section 12*a* is a plastic top body cover 18 which is secured to the top torso section 12*a* through the use of pegs 20 which are pressed into a series of corresponding peg holes 21. A spring clip 19 is advanceable over each peg 20 when pressed through a respective peg hole 21. Each spring clip 19 is advanced over a respective peg 20 until the spring clip 19 is in abutting contact with the top torso section 12*a*. Since each spring clip 19 is frictionally retained on a respective peg 20, the top body cover 18 is secured to a recess formed in the top torso section 12*a* when each spring clip 19 is in abutting contact with the top torso section 12*a*. The top cover 18 is easily removed from the top torso section 12*a* by prying the cover 18 to thereby release the spring clips 19 from respective pegs 20. As seen in FIG. 2, the top cover 18 is formed to resemble the top of an insect and can be formed to include body segments and a pair of eyes.

The insect 10 further includes a left wing 16*a* and a right wing 16*b* attached to the top torso 12*a* with the top cover 18 and pegs 20. The wings 16*a* and 16*b* are made from a thin, film-like plastic material such that the wings will flap when the torso 12 is moved. The wings 16*a* and 16*b* can be painted to match the colors and markings of the insect 10 that is being assembled. At least two of the pegs 20 are insertable into respective ones of a pair of holes 17 formed in the base of each wing 16*a* and 16*b*. Therefore, when the top cover 18 is secured to the top torso 12*a*, the wings 16*a* and 16*b* are secured in place by the pegs 20. The bases of the wings 16*a* and 16*b* are in laminar juxtaposition with the top cover 18 and the top torso 12*a* and are secured therebetween.

Figure 5:
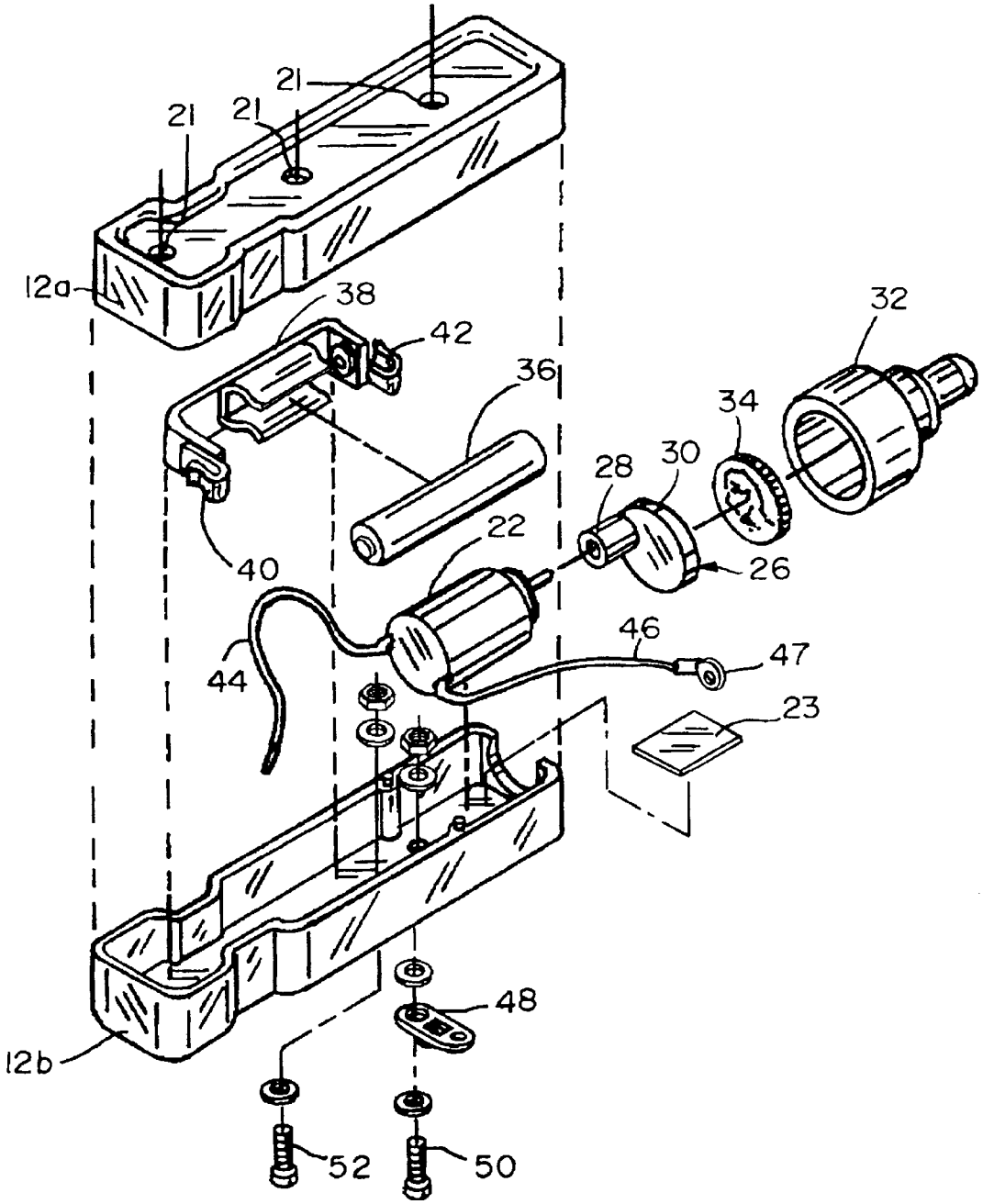
FIG. 5 is an exploded view of the torso of the walking insect shown in FIG. 1.

Disposed within the cavity formed by top torso section 12*a* and bottom torso section 12*b* is an electric motor 22. The motor 22 is retained within the bottom torso section 12*b* with a section of double sided tape 23. The double sided tape 23 attaches to a bottom side of the motor 22 and the interior floor of bottom torso section 12*b* in order to secure the motor 22 therein. Referring to FIG. 5, attached to the motor 22 via a rotating driveshaft 24 is a plastic eccentric member 26. The eccentric member 26 comprises a cylindrical attachment portion 28 having an interior diameter slightly smaller than the diameter of driveshaft 24. The attachment portion 28 is therefore slidably advancable over the driveshaft 24 and frictionally retained thereon. The eccentric member 26 further includes a circular cam portion 30 integrally formed with the attachment portion 28. The cam portion 30 is integrally formed with the attachment portion 28 such that the attachment portion 28 is near or at the outer circumference of the cam portion 30. Therefore, as the motor 22 rotates the driveshaft 24, an imbalance is created by the eccentric member 26 which oscillates the torso 12.

Figure 3:
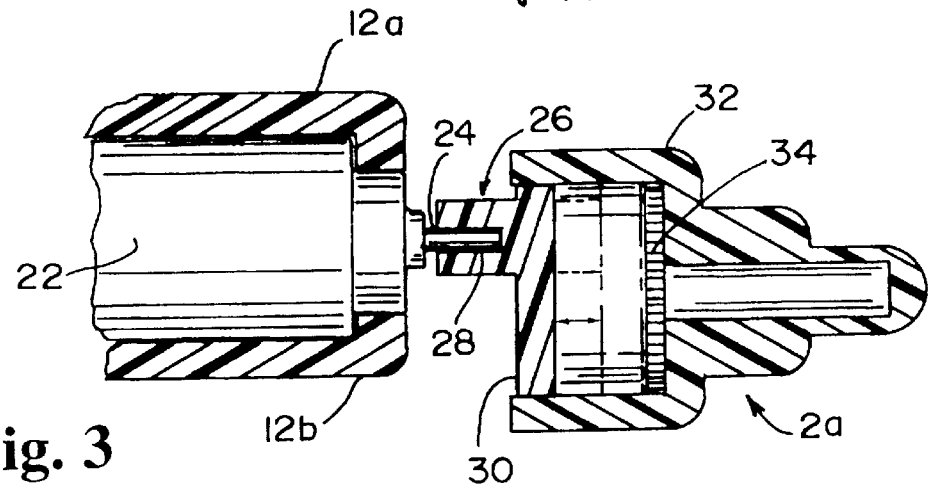
FIG. 3 is a cross-sectional view of the motor and counterbalance used in conjunction with the walking insect shown in FIG. 2.
Figure 4:
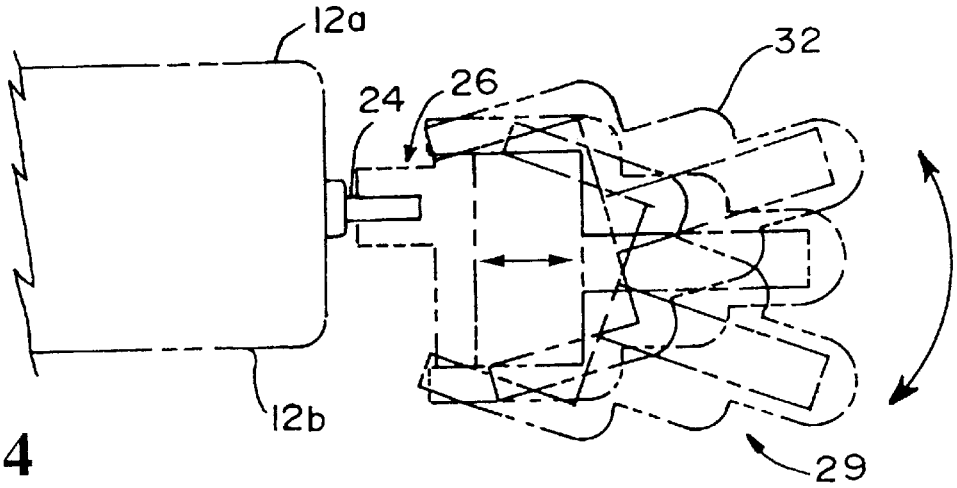
FIG. 4 illustrates the manner in which the counterbalance shown in FIG. 3 is positionable off-axis.

The insect 10 further comprises a plastic tail cone 32 that is slidably advancable onto the cam portion 30 as seen in FIGS. 3 and 5 in order to form a counterbalance 29. The tail cone 32 has an inner circular diameter that is slightly smaller than the diameter of cam portion 30 and a secondary axis along the length of the tail cone 32. As seen in FIG. 4, the tail cone 32 is advancable along and pivotally movable relative to the central axis of the cam portion 30. The adjustability of the tail cone 32 is facilitated by the ability to pivotally offset the secondary axis of tail cone 32 relative to the central axis of the cam portion 30 which allows for a selective increase or decrease in the level of the imbalance created by the counterbalance 29 while rotating. The imbalance will cause the torso to vibrate and cause the insect to walk as will be further explained below. In order to magnify the imbalance, a weight such as a coin 34 is placable within the interior of tail cone 32. The coin 34 adds weight to the tail cone 32 such that as the tail cone 32 and eccentric member 26 rotate, the imbalance created thereby is amplified.

In order to power the motor 22, the insect 10 further includes a battery 36 as a power source. The battery 36 is insertable into a battery holder 38 that snaps into the bottom torso section 12*b*. The battery holder 38 has a metallic first contact 40 and a metallic second contact 42 which are in electrical communication with respective ones of the positive and negative poles of battery 36. The motor 22 has a first wire 44 and a second wire 46 which are used to supply electricity to the motor 22. The first wire 44 is electrically attached to the first contact 40 of the battery holder 38.

In order to control the flow of electricity to motor 22, the insect 10 further includes a metallic switch 48. The switch 48 is attached to the bottom torso section 12*b* with a first metallic screw 50 and a corresponding nut and washer in a manner whereby the switch 48 is rotatable about the screw 50. The second wire 46 from motor 22 includes a wire connector 47 attached thereto. The wire connector 47 is advanceable over the first screw 50 that projects into the interior of bottom torso section 12*b* and his maintained in place with the nu threaded thereon. As seen in FIG. 5, the insect 10 includes a second metallic screw 52 insertable into the bottom torso section 12*b*. The second screw 52 is placed adjacent to the first screw 50 such that as the switch 48 is rotated toward the second screw 52, the switch makes contact therewith. The second screw 52 is also positioned within the bottom torso section 12*b* such that when the battery holder 38 is snapped into place, the second contact 42 of battery holer 38 is in electrical communication with the second screw 52. Therefore, in order to provide a flow of electricity to the motor 22, the switch must be rotated to make contact with the second screw 52. By making contact with the second screw 52, the switch 48 makes a closed electrical circuit between the battery 36 and the motor 22. Specifically, electricity can flow from a pole of battery 36 through the first contact 40 and first wire 44 into motor 22. Electricity also flows from motor 22 through second wire 46, wire connector 47, first screw 50, switch 48, second screw 52, second contact 42 and back to battery 36. The complete electrical circuit will thereby power motor 22. If switch 48 is not in contact with second screw 52, then the electrical circuit will not be completed and the motor 22 will not rotate. As will be recognized to those of ordinary skill in the art, the flow of electricity may be reversed by reversing the poles of the battery 36 in battery holder 38.

Figure 6:
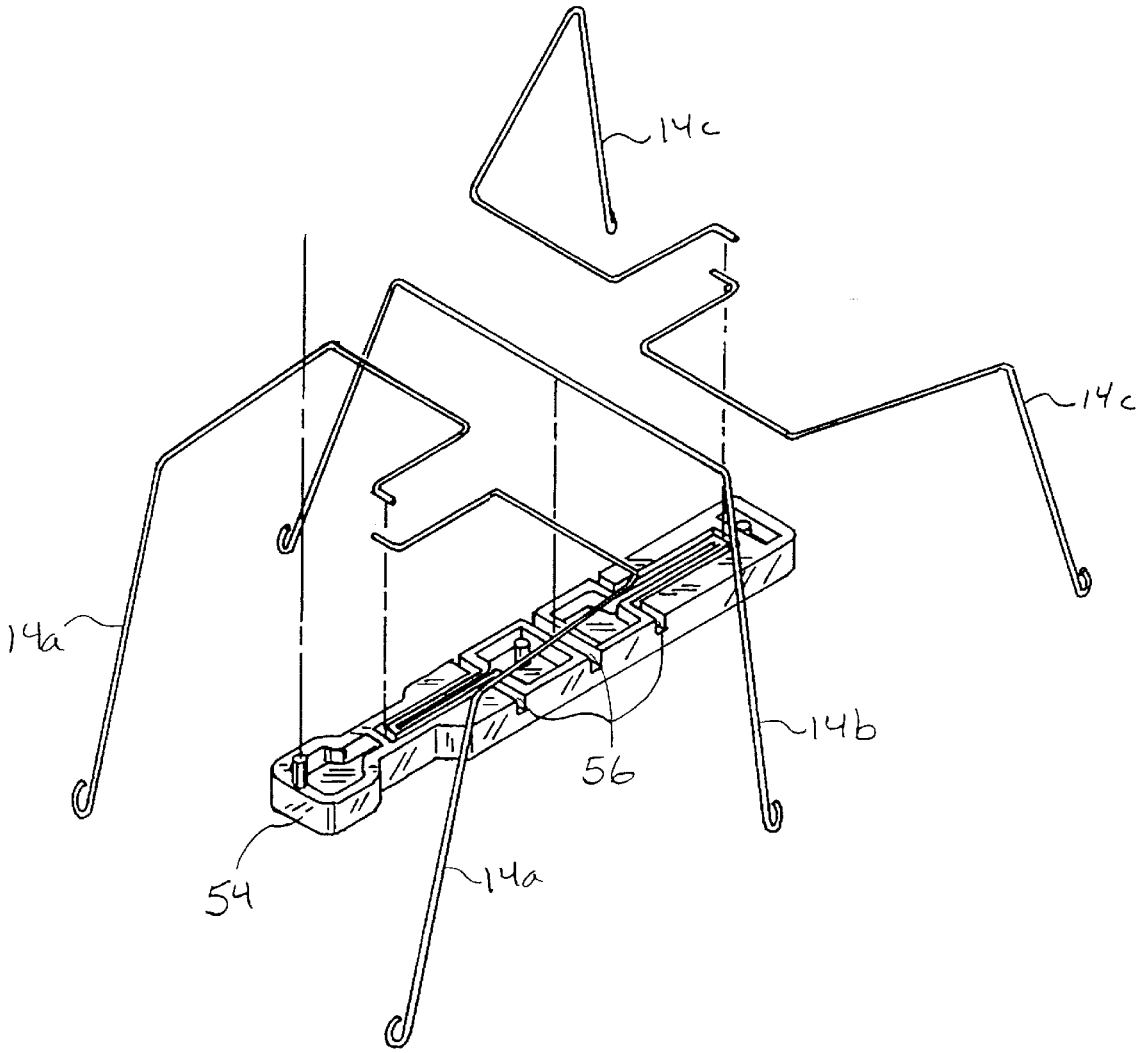
FIG. 6 is an exploded view of the legs and bottom cover of the walking insect shown in FIG. 1.

As previously described, the insect 10 includes a set of metallic legs 14*a*, 14*b*, and 14*c* that support the insect 10 and allow the insect to walk. Each set of legs 14*a*, 14*b* and 14*c* comprise a left and right segment which project outwardly from a respective side of the torso 12. The legs 14*a–c* are bent such that the legs 14*a–c* act as springs. The legs 14*a–c* are attached to the bottom torso section 12*b* by bottom cover 54 as seen in FIG. 2. As will be recognized by those of ordinary skill in the art, the legs 14*a–c* can be formed from a unitary section of wire or be formed from two sections of wire such that each pair of legs 14*a–c* comprises two pieces. The bottom cover 54 has a series of pegs which are receivable into corresponding peg holes formed within the bottom torso section 12*b*. As with the top cover 18, the pegs of the bottom cover 54 are secured to the bottom torso section 12*b* through the use of spring clips (not shown) which are advancable over each respective peg. As seen in FIG. 6, the bottom cover 54 is formed with channels 56 for the legs 14*a*, 14*b*, and 14*c*. The channels 56 are formed on the interior side (i.e., the side that abuts bottom torso section 12*b*) of bottom cover 54 such that legs 14*a*, 14*b*, and 14*c* are secured between the bottom cover 54 and the bottom torso section 12*b*. The channels 56 are formed such that the legs 14*a*, and 14*c* cannot rotate in order to support the insect 10. Additionally, the bottom cover 54 is formed such that the first and second screws 50 and 52 are insertable therethrough and the heads of the screws 50 and 52, as well as switch 48, are disposed on the exterior surface of the bottom cover 54.

In the preferred embodiment of the present invention, the insect 10 has three pairs of legs 14*a*, 14*b*, and 14*c*. However, it will be recognized that if the insect 10 is a spider, more legs will be necessary. As the motor 22 rotates the eccentric member 26 and tailcone 32, the insect 10 will vibrate in a manner wherein the torso 12 oscillates upwardly and downwardly. Since the legs 14*a–c* are springlike, the oscillation of the torso 12 will cause the legs 14*a–c* to move thereby causing the insect 10 walk. In addition to the legs 14*a*, 14*b*, and 14*c* moving from the vibration, the wings 16*a*, 16*b* will also flap adding realism to the insect 10.

In the preferred embodiment of the present invention, the insect 10 is sold as a kit with an instruction booklet and/or educational guide. The instruction booklet will provide the child with the necessary instructions and order of assembly to fabricate the insect 10. As described above, all of the pieces either snap or screw together thereby making assembly easy. The educational guide may describe the biological features of the insect 10 while the child assembles the insect 10. Additionally, the educational guide may describe the mechanics of how the insect 10 walks by describing the physics involved in facilitating the vibration of insect 10. By assembling the walking insect 10, a child will have learned about the biological and physical sciences as well as assembled a fun toy that the child can play with.

Additional modifications and improvements of the present invention may also be apparent to those of ordinary skill in the art such as making the insect 10 a butterfly. Thus, the particular combination of parts described and illustrated herein is intended to represent only certain embodiments of the present invention, and is not intended to serve as limitations of alternative devices within the spirit and scope of the invention.

What is claimed is:

1. A walking insect kit comprising:

a torso;

at least one set of flexible legs attachable to the torso;

a motor mountable within the torso;

a power source connectable to the motor; and a counterbalance attachable to the motor and rotatable thereby, the rotation of the counterbalance being operative to vibrate the torso and the legs thereby causing the insect to walk.

2. The insect kit of claim 1 further comprising a set of wings attachable to the torso and configured to flap during the vibration of the torso.

3. The insect kit of claim 1 further comprising a switch connectable between the motor and the power source for selectively activating and deactivating the motor.

4. The insect kit of claim 3 wherein the motor is an electric motor and the power source is a battery.

5. The insect kit of claim 1 wherein the legs are fabricated from a flexible metallic material.

6. The insect kit of claim 1 wherein the counterbalance comprises:

an eccentric member attachable to the motor; and a tail cone attachable to the eccentric member and pivotally adjustable relative thereto.

7. The insect kit of claim 6 wherein:

the eccentric member has a circular cam portion which defines a central axis; and the tail cone defines a secondary axis;

the tail cone being attachable to the cam portion such that the secondary axis is angularly offset relative to the central axis for purposes of adjusting the vibration of the torso.

8. The insect kit of claim 7 further comprising a weight insertable into the tail cone for adjusting the vibration of the torso.

9. A walking insect comprising:

a torso;

at least one set of flexible legs attached to the torso;

a motor mounted within the torso;

a power source connected to the motor; and a counterbalance attached to the motor and rotatable thereby, the rotation of the counterbalance being operative to vibrate the torso and the legs thereby causing the insect to walk.

10. The insect of claim 9 further comprising a pair of wings attached to the torso and configured to flap during vibration of the torso.

11. The insect of claim 9 further comprising a switch connected between the motor and the power source for selectively activating and deactivating the motor.

12. The insect of claim 11 wherein the motor is an electric motor and the power source is a battery.

13. The insect of claim 9 wherein the legs are fabricated from a flexible metallic material.

14. The insect of claim 9 wherein the counterbalance comprises:

an eccentric member attachable to the motor; and a tail cone attachable to the eccentric member and pivotally adjustable relative thereto.

15. The insect of claim 14 wherein:

the eccentric member has a circular cam portion which defines a central axis; and the tail cone defines a secondary axis;

the tail cone being attachable to the cam portion such that the secondary axis is angularly offset relative to the central axis for purposes of adjusting the vibration of the torso.

16. The insect of claim 15 further comprising a weight inserted within the tail cone for adjusting the vibration of the insect.

17. A method of assembling a walking insect having a torso, at least one set of flexible legs, a rotating motor, a counterbalance and a power source, the method comprising the steps of:

a) attaching the legs to the torso;

b) mounting the motor to the torso;

c) rotatably mounting the counterbalance to the motor;

d) attaching the power source to the torso; and e) connecting the power source to the motor such that the rotation of the counterbalance facilitated by the activation of the motor vibrates the torso and legs thereby causing the insect to walk.

18. The method of claim 17 wherein the walking insect further includes a weight and step (c) further includes inserting the weight into the counterbalance to adjust the vibration of the torso.

19. The method of claim 17 wherein the walking insect further includes a pair of wings and step (a) further comprises attaching the pair of wings to the torso.

* * * * *